US008328308B2

(12) United States Patent
Kurashina

(10) Patent No.: US 8,328,308 B2
(45) Date of Patent: Dec. 11, 2012

(54) FLUID EJECTING APPARATUS, FLUID EJECTING HEAD CONTROL METHOD IN FLUID EJECTING APPARATUS, AND DRIVING WAVEFORM GENERATING APPARATUS FOR FLUID EJECTING HEAD

(75) Inventor: Teruki Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 12/795,777

(22) Filed: Jun. 8, 2010

(65) Prior Publication Data

US 2011/0012948 A1 Jan. 20, 2011

(30) Foreign Application Priority Data

Jul. 15, 2009 (JP) ..... 2009-166760

(51) Int. Cl.
*B41J 29/38* (2006.01)

(52) U.S. Cl. ..... 347/10

(58) Field of Classification Search ..... 347/9–11
See application file for complete search history.

(56) References Cited

U.S. PATENT DOCUMENTS 6,758,544 B2 7/2004 Fukano

FOREIGN PATENT DOCUMENTS

| | | | |
|---|---|---|---|
| JP | 2000-052623 | A | 2/2000 |
| JP | 2003-001824 | A | 1/2003 |
| JP | 2003-118136 | A | 4/2003 |
| JP | 2007-069448 | A | 3/2007 |
| JP | 2008-023778 | A | 2/2008 |

*Primary Examiner* — An Do

(74) *Attorney, Agent, or Firm* — Nutter McClennen & Fish LLP; John J. Penny, Jr.; Christina M. Sperry

(57) ABSTRACT

Disclosed is a fluid ejecting apparatus including a fluid ejecting head that ejects fluid, a waveform generator that transmits a driving waveform for driving the fluid ejecting head to the fluid ejecting head, and a waveform designation signal transmitter that transmits a waveform designation signal for designating a driving waveform to be generated to the waveform generator, wherein the waveform generator transmits the driving waveform at a timing based on a reception timing of the waveform designation signal.

14 Claims, 6 Drawing Sheets

TD

| WAVEFORM TYPE PARAMETER WP | WAVEFORM TYPE DATA WD (16 BIT) |
|---|---|
| PRINT SPEED MODE 1 | 000·····01 |
| ⋮ | ⋮ |
| PRINT SPEED MODE Q | 000···1···00 |
| FLUSHING | 010·····00 |
| MICRO-VIBRATION | 100·····00 |

FLUID EJECTING APPARATUS, FLUID EJECTING HEAD CONTROL METHOD IN FLUID EJECTING APPARATUS, AND DRIVING WAVEFORM GENERATING APPARATUS FOR FLUID EJECTING HEAD

BACKGROUND

1. Technical Field

The present invention, for example, relates to a fluid ejecting apparatus provided with a fluid ejecting head that ejects fluid such as ink as with an ink jet printer and the like, a fluid ejecting head control method in the fluid ejecting apparatus, and a driving waveform generating apparatus for a fluid ejecting head.

2. Related Art

According to the related art, as one of a fluid ejecting apparatus that ejects fluid, an ink jet printer provided with a recording head that ejects ink has been known (e.g., JP-A-2003-1824 and the like). In the printer disclosed in JP-A-2003-1824, a voltage with a predetermined driving waveform is applied to a piezoelectric vibrator provided for each nozzle in the recording head, resulting in ejection of an ink droplet. A driving waveform signal (a trapezoidal waveform signal) for controlling the waveform of the voltage applied to the piezoelectric vibrator is generated by a driving signal generating circuit (a waveform generator) provided in a control circuit that controls the recording head, and is transmitted to a head driving circuit in the recording head. At this time, discharge data (ejection information) representing the existence or absence of ejection from each nozzle is transmitted from the control circuit to the head driving circuit. At this time, the head driving circuit does not apply a voltage to a piezoelectric vibrator corresponding to a nozzle for which the discharge data has a value of "0", and applies a voltage to a piezoelectric vibrator corresponding to a nozzle for which the discharge data has a value of "1", thereby selecting a nozzle, which ejects an ink droplet, based on the discharge data.

Further, the control circuit receives a pulse signal (encoder pulse signal) from an encoder that detects a relative position between the recording head and a recording medium (a target). Then, the driving waveform signal generating circuit in the control circuit transmits (outputs) a driving waveform signal in each period proportional to a pulse period on the basis of the encoder pulse signal. Further, the control circuit transmits a print timing signal generated from the encoder pulse signal to the recording head, thereby controlling ejection of the recording head based on the driving waveform signal and the discharge data at the timing synchronized to the print timing signal. In addition, in the printer disclosed in JP-A-2003-1824, one recording head is provided. However, there has been disclosed a serial printer (e.g., JP-A-2003-118136 and the like) and a line printer (e.g., JP-A-2007-69448 and the like), which are provided with a plurality of recording heads.

However, when constituting a printer provided with a plurality of recording heads, as disclosed in JP-A-2003-118136 and JP-A-2007-69448, by using the recording head and the control circuit disclosed in JP-A-2003-1824, it is necessary to provide a plurality of recording heads and a plurality of control substrates, respectively. In such a case, if the control circuit is provided in an upper level substrate, which mainly outputs an indication necessary for control, and a lower level substrate which controls the recording heads according to the indication, for example, a user-maker can set indication content depending on needs in the upper level substrate, and the lower level substrate and the recording heads can be provided as a generalized product which is common in all user-makers. Particularly, when employing a configuration in which a plurality of (M) lower level substrates are connected to one upper level substrate, the total number of substrates is reduced, so that the configuration of a recording head unit and assembly work thereof can be simplified, and the number of the lower level substrates connected to the upper level substrate can be limited to a required number smaller than M.

Further, the control circuit may be provided with a waveform designation signal transmitter that transmits a waveform designation signal for designating the waveform of the driving waveform signal. It is however preferable that the waveform designation signal transmitter is provided in the upper level substrate such that a required waveform can be appropriately set. In addition, since the driving signal generating circuit generates a driving waveform signal with a waveform designated by the waveform designation signal, it is preferred that the driving signal generating circuit is provided in the lower level substrate.

In such a case, it is necessary to transmit pulse period information of the encoder to the driving waveform signal generating circuit of the lower level substrate. For example, it may be possible to employ a configuration in which signal lines from the encoder are wired to the plurality of (M) lower level substrates individually. However, since M signal lines are necessary, an increase in the number of wires is inevitable. In this regard, there has been proposed a configuration in which the signal lines from the encoder are connected to the upper level substrate, and a timing signal, which has the same period as that of the encoder pulse signal or has a pulse period proportional to that of the encoder pulse signal, is transmitted from the upper level substrate to the plurality of lower level substrates. However, even in such a configuration case, timing signal lines for transmitting M timing signals are required between the upper level substrate and the plurality of (M) lower level substrates, resulting in complication of a wiring structure and assembly work due to an increase in the number of the signal lines. Since such problems occur, even if the timing signal is not transmitted from the upper level substrate including the waveform designation signal transmitter to the lower level substrate including the driving waveform signal generating circuit (waveform generator) through the timing signal lines based on the encoder pulse signal, it is desired to realize a configuration capable of indicating a generation timing of the driving waveform signal (driving waveform).

SUMMARY

An advantage of some aspects of the invention is to provide a fluid ejecting apparatus capable of indicating a generation timing of a driving waveform without transmitting a timing signal from a waveform designation signal transmitter to a waveform generator through a timing signal line, a fluid ejecting head control method in the fluid ejecting apparatus, and a driving waveform generating apparatus for a fluid ejecting head.

According to one aspect of the invention, there is provided a fluid ejecting apparatus including: a fluid ejecting head that ejects fluid; a waveform generator that transmits a driving waveform for driving the fluid ejecting head to the fluid ejecting head; and a waveform designation signal transmitter that transmits a waveform designation signal for designating a driving waveform to be generated to the waveform generator, wherein the waveform generator transmits the driving waveform at a timing based on a reception timing of the waveform designation signal.

According to the aspect of the invention, the waveform designation signal transmitter transmits the waveform designation signal for designating the generated driving waveform to the waveform generator. The waveform generator generates a driving waveform with a waveform designated by the received waveform designation signal at the timing based on the reception timing of the waveform designation signal, and transmits the driving waveform to the fluid ejecting head. Consequently, it is possible to indicate a generation timing (a transmission timing) of the driving waveform without transmitting a timing signal from the waveform designation signal transmitter to the waveform generator through a timing signal line. For example, since wiring of a timing signal line for transmitting a timing signal is not necessary, the number of desired wirings can be reduced.

In the fluid ejecting apparatus of the aspect of the invention, preferably, the waveform designation signal transmitter transmits the waveform designation signal and information regarding existence or absence of ejection in the fluid ejecting head through a single wiring.

According to the aspect of the invention, the waveform designation signal transmitter transmits the waveform designation signal and ejection information regarding existence or absence of ejection in the fluid ejecting head to the waveform generator through a single wiring. Consequently, the wiring for transmitting the waveform designation signal and the ejection information is used in common, so that the number of desired wirings can be reduced.

In the fluid ejecting apparatus of the aspect of the invention, preferably, the waveform generator is provided in a plural number, and the waveform designation signal transmitter separately transmits the waveform designation signal to each waveform generator.

According to the aspect of the invention, the waveform designation signal transmitter transfers a generation timing of a driving waveform in each waveform generator by using the waveform designation signal separately transmitted to each waveform generator. Consequently, since it is not necessary to transmit a timing signal from the waveform designation signal transmitter to each waveform generator through a timing signal line, a plurality of signal lines for transmitting a timing signal are not necessary, resulting in the reduction in the number of wirings.

In the fluid ejecting apparatus of the aspect of the invention, preferably, the waveform generator transmits the driving waveform at a timing after a predetermined time elapses from reception start of the waveform designation signal or reception completion of the waveform designation signal. In addition, the predetermined time may also be an internal processing time required until the waveform generator receives the waveform designation signal to generate and transmit the driving waveform, or a counted time up to a transmission timing after a reception time of the waveform designation signal is employed as a reference. In such a case, the predetermined time may also include "0" when the reception start or reception completion of the waveform designation signal and the transmission timing of the driving waveform are regarded as the same time.

According to the aspect of the invention, the waveform generator transmits the driving waveform at the timing after the predetermined time elapses from the reception start of the waveform designation signal or the reception completion of the waveform designation signal. Consequently, after the time point of the reception start or the reception completion of the waveform designation signal is employed as a reference time point, the waveform generator transmits the driving waveform at the timing after the predetermined time elapses from the reference time point, so that it is possible to transmit the driving waveform with a period synchronized with a period of the reception timing of the waveform designation signal. For example, when a reference time point is employed in the middle of receiving the waveform designation signal as a basis, a counting process from the reception start to the reference time point in the middle of receiving the waveform designation signal may be necessary. However, the reception start timing or the reception completion timing is employed as the reference time point, so that a timing at the reference time point can be relatively simply achieved.

In the fluid ejecting apparatus of the aspect of the invention, preferably, the waveform generator transmits the driving waveform with a period synchronized with a reception period of the waveform designation signal, and, when a waveform designated by the waveform designation signal is changed from a first waveform to a second waveform, the waveform generator transmits the driving waveform with the second waveform from a period subsequent to a period in which a waveform designation signal for designating the second waveform is received.

According to the aspect of the invention, the waveform generator transmits the driving waveform with the period synchronized with the reception period of the waveform designation signal. At this time, when the waveform designated by the waveform designation signal is changed from the first waveform to the second waveform, the waveform generator transmits the driving waveform with the second waveform from the period subsequent to the period in which the waveform designation signal for designating the second waveform is received. Consequently, the second waveform can be transmitted immediately from the subsequent period, so that the waiting time from the time point at which the waveform designated by the waveform designation signal is changed to the transmission of the driving waveform with the changed waveform can be reduced. For example, since the holding time for holding information on the designated waveform is short, the time for occupying a storage area (e.g., a memory and a register) can be reduced due to the information on the waveform.

According to another aspect of the invention, there is provided a fluid ejecting head control method in a fluid ejecting apparatus provided with a fluid ejecting head that ejects fluid, the method including: transmitting by a waveform designation signal transmitter a waveform designation signal for designating a driving waveform to be generated to the waveform generator; and transmitting by a waveform generator a driving waveform for driving the fluid ejecting head to the fluid ejecting head at a timing based on a reception timing of the waveform designation signal. According to the aspect of the invention, the same effect as that according to the fluid ejecting apparatus can be achieved.

According to further another aspect of the invention, there is provided a driving waveform generating apparatus for a fluid ejecting head, including: a waveform generator that generates a driving waveform for driving a fluid ejecting head that ejects fluid and transmits the driving waveform to the fluid ejecting head, wherein the waveform generator receives a waveform designation signal for designating a driving waveform to be generated from a waveform designation signal transmitter that transmits the waveform designation signal for designating the driving waveform to be generated, and generates a driving waveform designated by the waveform designation signal and transmits the generated driving waveform to the fluid ejecting head at a timing based on a reception timing of the waveform designation signal. According to the aspect of the invention, when employing a configuration of combining the driving waveform generating apparatus with the waveform designation signal transmitter, a signal line for a timing signal is not necessary between the driving waveform generating apparatus and the waveform designation signal transmitter, so that the number of wirings can be reduced, that is, the same effect as that according to the fluid ejecting apparatus can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
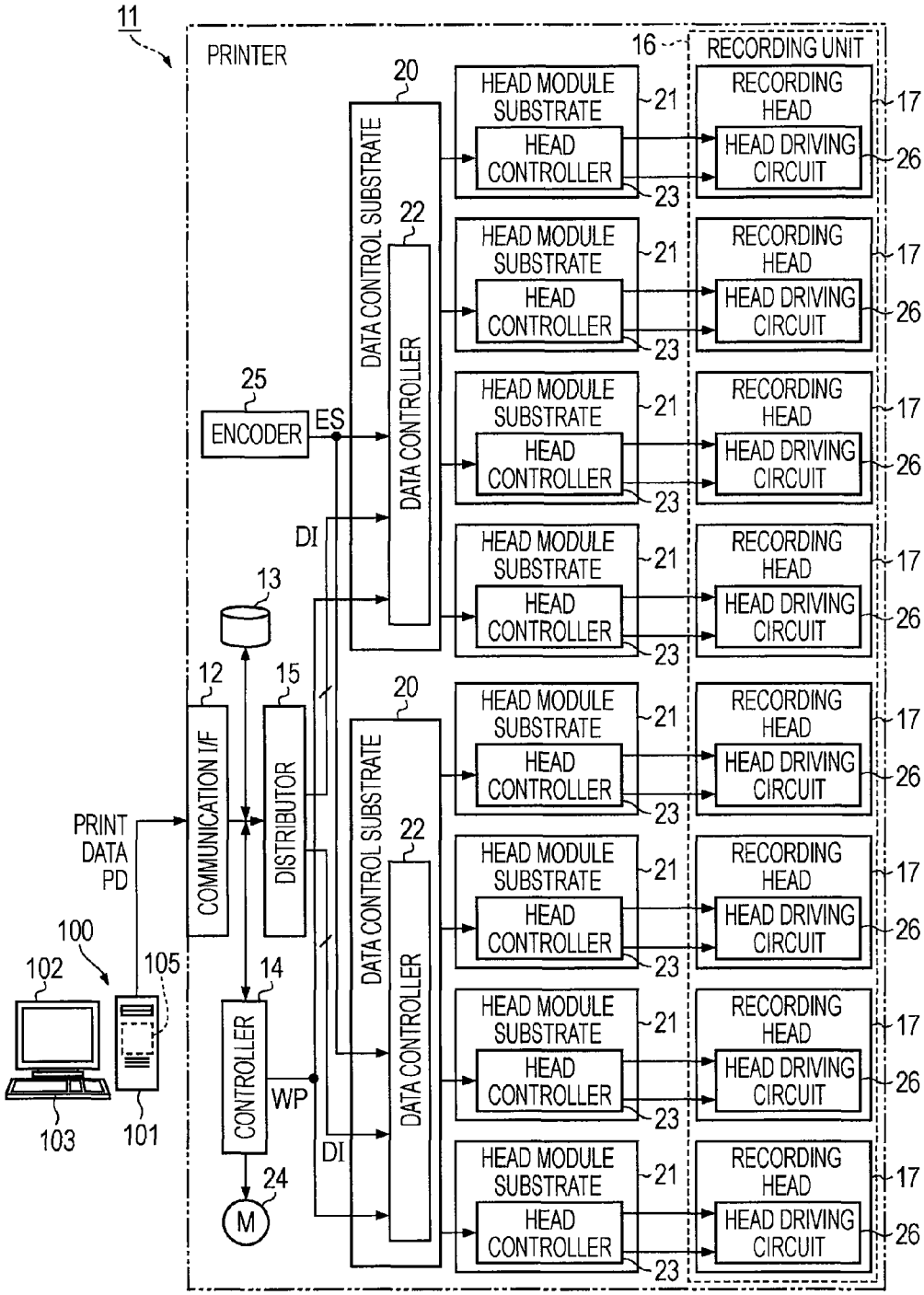
FIG. 1 is a block diagram illustrating the electrical configuration of an ink jet printer according to one embodiment.

Hereinafter, one embodiment of the invention will be described with reference to FIGS. 1 to 7. FIG. 1 is a block diagram illustrating the electrical configuration of an ink jet printer as a fluid ejecting apparatus.

As shown in FIG. 1, the ink jet printer (hereinafter, simply referred to as a "printer 11") is communicatively connected to a host apparatus 100 to perform printing based on printing data PD received from the host apparatus 100. The host apparatus 100, for example, includes a personal computer, and is provided with a body 101, a monitor 102 and an input device 103. The body 101 has a printer driver 105 therein. For example, if a user commands performance of printing by operating the input device 103, the printer driver 105 generates printing data PD interpretable by the printer 11 from data (image data or document data) such as an image and a document displayed on the monitor 102, and transmits the printing data PD to the printer 11.

In detail, the printer driver 105, for example, performs a resolution conversion process, a color conversion process, a halftone process, a rasterizing process and the like with respect to image data to be printed, thereby generating print data (raster data) in which one bit is expressed by a plurality of grayscales (in the present embodiment, two grayscales). Further, the printer driver 105 generates the printing data PD by adding a header, which includes both print condition information having a paper size, a paper type, print speed mode designation information and the like, and a command giving instructions for various printing operations such as paper feeding, printing and paper supply, to the print data.

The printer 11 includes a communication interface (hereinafter, referred to as a "communication I/F 12"), and receives the printing data PD from the host apparatus 100 through the communication I/F 12. The printing data PD received through the communication I/F 12 is temporarily stored in a buffer 13. A controller 14 analyzes a command of the printing data PD read from the buffer 13 to allow the printer 11 to perform a printing operation indicated by the command. The controller 14 transmits print data (raster data) of the printing data PD to a distributor 15. In addition, the printer 11 stores only print data corresponding to a plurality of lines (rows) due to the limitation of a data storage area. For this reason, communication is performed between the host apparatus 100 and the printer 11, and the printing data PD corresponding to one line is transmitted to the printer 11 whenever printing of one line is completed by the printer 11 and the storage area in the printer 11 is empty.

As shown in FIG. 1, the printer 11 is provided with a recording unit 16 for ejecting ink onto a recording medium (e.g., a paper) serving as a target. The recording unit 16 of the present embodiment has a configuration in which a plurality of recording heads 17 are arranged in a predetermined arrangement pattern (FIG. 1 schematically shows arrangement of one column without showing the arrangement pattern).

A data control substrate 20 and a head module substrate 21 are provided between the distributor 15 and each recording head 17 to serve as a control-based circuit (electronic circuit) that performs ejection control of each recording head 17 based on print data. Each of the substrates 20 and 21 is provided with a plurality of connectors (not shown), "M" head module substrates 21 can be connected to one data control substrate 20, and "K" recording heads 17 can be connected to one head module substrate 21. FIG. 1 shows an example in which the number "N" of the data control substrates 20 is "2", the number "M" of the head module substrates 21 is "4", and the number "K" of the recording heads 17 is "1". Herein, the numbers "N", "M" and "K" can be appropriately changed, and for example the number "K" may be a plural number ($K \geqq 2$). If the number "K" is a plural number, the number of the head module substrates 21 is restricted to a small number with respect to the number of the recording heads, so that the number of parts of the recording head unit is reduced, resulting in the simplification of assembly work thereof. Preferably, the number "M" is a plural number ($M \geqq 2$). This is because the number of connections of the head module substrates 21 with respect to the data control substrate 20 can be increased and decreased according to the necessary number of the recording heads 17, and the necessary number of the head module substrates 21 can be reduced, resulting in the prevention of the wastefulness of the circuit. In addition, in the present embodiment, the data control substrate 20 corresponds to a waveform designation signal transmitter and the head module substrate 21 corresponds to a waveform generator.

The use of one distributor 15, N data control substrates 20, (N×M) head module substrates 21, (N×M×K) recording heads 17 enables the recording head unit to be used for a serial printer and a line printer. In addition, the head module substrate 21 and the recording head 17 are connected to each other through a flexible flat cable.

Further, as shown in FIG. 1, the printer 11 is provided with an electric motor 24, which serves as a power source of a driving unit that moves the recording head 17 relative to the recording medium (a paper and the like), and an encoder 25 used for measuring a relative position in the movement direction of the recording head 17 relative to the recording medium. The encoder 25 outputs an encoder pulse signal ES including the number of pulses proportional to a movement distance of the recording head 17 relative to the recording medium, and a pulse of a pulse period which is inverse proportional to a movement speed of the recording head 17 relative to the recording medium.

In the present embodiment, a control-based electronic circuit (a control circuit) for controlling driving of the recording head 17 is divided into the data control substrate 20 with relatively high flexibility, which can be set according to needs (a recording scheme such as a serial type and a line type, a design concept and the like) for each user-maker, and the head module substrate 21 with relatively high versatility, which does not permit setting change and performs a control process according to commands from an upstream side (i.e., the data control substrate 20). For example, a user-maker uses the recording head 17 and the head module substrate 21, and combines the recording head 17 and the head module substrate 21 with the data control substrate 20 for which a desired setting is made, thereby constructing a desired recording head unit relatively and simply. Further, the recording head unit is mounted in a casing unit, so that the printer 11 (the fluid ejecting apparatus) with a desired function can be fabricated relatively and easily.

Further, since the head control-based electronic circuit is divided into two substrates 20 and 21, the number of wirings for connecting the controller 14 and the encoder 25 to the two substrates 20 and 21 may be increased. However, in the present embodiment, with a configuration which will be described later, the number of wirings can be restricted to a relatively small number as compared with the number of the recording heads 17. In addition, detailed configurations of the printer 11 provided with the recording head unit of the present embodiment will be described according to recording schemes.

Each data controller 22 shown in FIG. 1 receives discharge data DI corresponding to four heads from the distributor 15, the encoder pulse signal ES from the encoder 25, and a waveform type parameter WP from the controller 14. Then, the data controller 22 adds the waveform type parameter WP to discharge data SI of the discharge data DI, which corresponds to one nozzle array configured to simultaneously eject ink droplets, and sequentially outputs the discharge data SI to head controllers 23 every printing period proportional to the pulse period of the encoder pulse signal ES.

Each head controller 23 generates a driving waveform signal COM with a waveform indicated by the waveform type parameter WP, and transmits the generated driving waveform signal COM and the discharge data SI to a head driving circuit 26 in the recording head 17 at timings according to each printing period. The present embodiment is characterized in that the data controller 22 transmits data to the head controller 23 every period proportional to the pulse period of the encoder pulse signal ES, and the head controller 23 generates a transmission timing of the driving waveform signal COM and a print timing signal with a period synchronized with a timing at which the data is received from the data controller 22. With such a characteristic configuration, a signal line of the encoder 25 is not necessary to be connected to each head controller 23. In addition, detailed configurations and processing of the data control substrate 20 and the head module substrate 21 will be described later.

Next, respective configurations of a serial printer and a line printer, to which the recording head unit is applied, will be described in brief. The plurality of recording heads 17 are arranged in a predetermined arrangement pattern according to the recording scheme of the printer employing the recording head unit.

Figure 2:
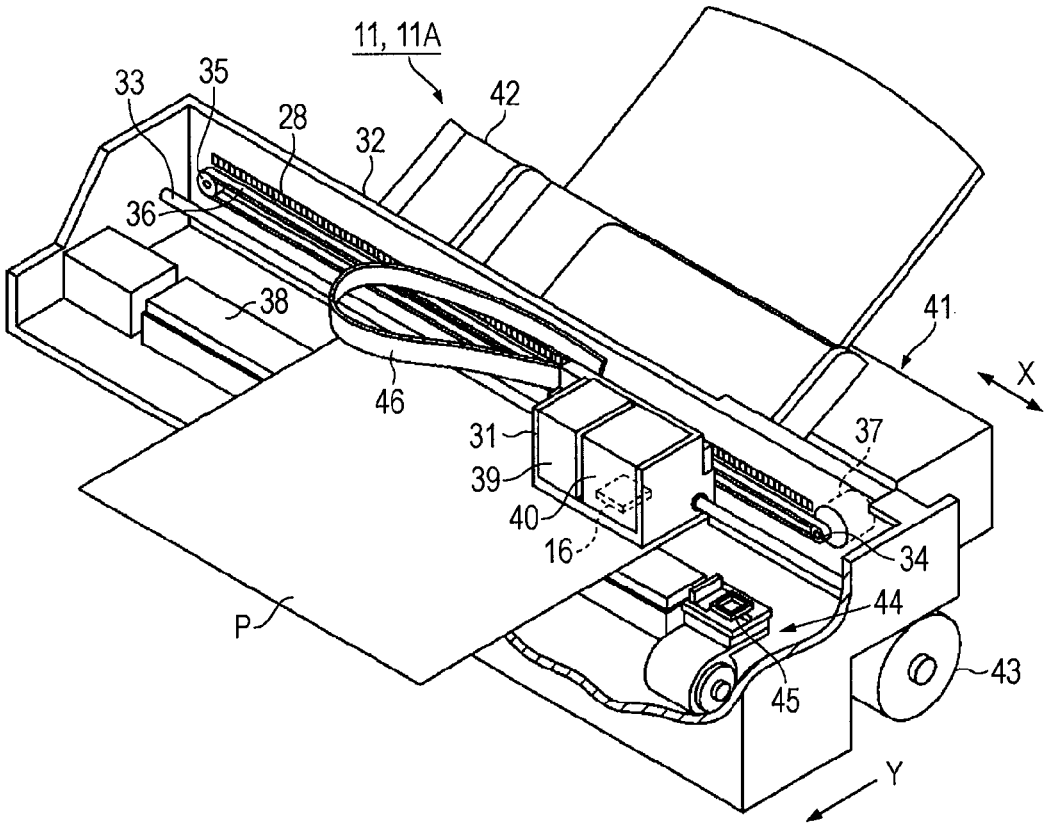
FIG. 2 is a perspective view schematically illustrating a printer using a serial recording scheme.

First, the configuration of the serial printer will be described based on FIG. 2. FIG. 2 is a perspective view schematically illustrating the serial printer. When the printer 11 is the serial printer 11A shown in FIG. 2, a carriage 31 provided at the lower portion thereof with the recording unit 16 reciprocates along a guide shaft 33 installed in a body case 32 in the main scanning direction (the X direction in FIG. 2). The carriage 31 is fixed to an endless timing belt 36 wound around a pair of pulleys 34 and 35 installed at an inner surface of a back substrate of the body case 32, and a carriage motor 37 having a driving shaft connected to the pulley 34 rotates in forward and backward directions, so that the carriage 31 reciprocates in the main scanning direction X.

As shown in FIG. 2, a platen 38 is disposed at a lower position facing the recording unit 16 in the body case 32 while extending in the direction X to control a gap between the recording unit 16 and a recording medium P (a paper). Further, inks, which are supplied from ink cartridges 39 and 40 for black and color detachably mounted on the upper portion of the carriage 31, are ejected (discharged) from ink color-based nozzles of the recording heads 17 (see FIG. 1) constituting the recording unit 16.

An auto sheet feeder 41 mounted on the back side of the printer 11 supplies a plurality of sheets of the recording medium P piled on a paper feeding tray 42 toward the downstream side of the sub-scanning direction Y one by one. Further, a paper feeding motor 43 installed at the lower portion of the right side of the body case 32 in FIG. 2 is driven, so that a pair of paper feeding rollers and a pair of paper discharging rollers (not shown) are rotated, and the fed recording medium P is intermittently carried in the sub-scanning direction Y. Further, during the reciprocation of the carriage 31 in the main scanning direction X, both a print operation, in which inks are ejected toward the recording medium P from the nozzles of the each recording head 17 constituting the recording unit 16, and a paper feeding operation, in which the recording medium P is intermittently carried in the sub-scanning direction Y at a predetermined carrying amount, are repeated approximately alternately, so that characters, images and the like are printed on the recording medium P based on the printing data PD.

Further, in the serial printer 11A, the encoder 25 is a linear encoder extending along the guide shaft 33. The encoder 25 is provided with a linear scale, which includes a code plate with a tape shape having a plurality of slits perforated at regular intervals, and a pair of sensors with a light emitting and receiving function, and outputs the encoder pulse signal ES with the number of pulses proportional to the movement distance of the carriage 31 (the recording head unit 16). The controller 14 (see FIG. 1) controls driving of the carriage motor 37 based on the movement position, the movement direction and the movement speed of the carriage 31 which are achieved using the encoder pulse signal ES input from the encoder 25, thereby controlling the speed and the position of the carriage 31. In addition, a maintenance device 44 is installed directly below the carriage 31 located at a home position to perform a cleaning operation in order to prevent and solve clogging of the nozzles of the recording unit 16. The maintenance device 44 is provided with a cap 45 for capping the recording unit 16 located at the home position. A flushing operation of idly discharging ink droplets from all nozzles of the recording unit 16 after the carriage 31 regularly moves at the home position during printing is performed toward the inside of the cap 45. In addition, the recording unit 16 is connected to the head module substrate 21 (see FIG. 1) through a flexible flat cable (hereinafter, referred to as a "FFC 46").

In the case of the serial printer 11A, according to the related art, since each head module substrate has a configuration with the function of a data controller, (N×M) number of signal lines from an encoder are necessary to be connected to each head module substrate. However, in the present embodiment, only N signal lines from the encoder 25 are connected to N data control substrates 20. Consequently, in the present embodiment, the number of the signal lines of the encoder 25 is N (2 in one example) as compared with the existing configuration in which the number of the signal lines is (N×M) (8 in one example), so that the number of the signal lines is reduced by 1/M of the number of the signal lines necessary for the existing configuration.

Figure 3:
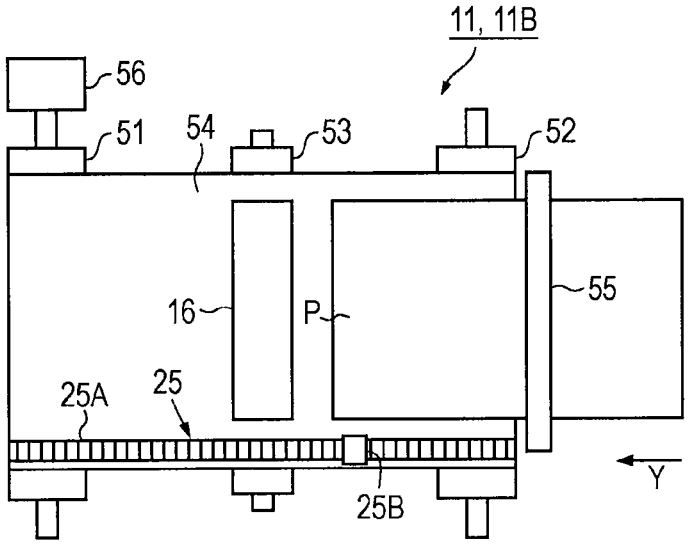
FIG. 3 is a plan view schematically illustrating a printer using a line recording scheme.

Next, a line printer will be described. FIG. 3 is a plan view schematically illustrating the line printer. As shown in FIG. 3, when the printer 11 is the line printer 11B, the recording medium P is fed onto a transfer belt 54, which is wound around a plurality of rollers 51 to 53, by a roller 55. The recording unit 16 is spaced apart upward (a front side in the direction perpendicular to the plane in FIG. 3) from the surface of the transfer belt 54 in the approximate center in the transfer direction of the transfer belt 54 by a predetermined gap. The recording unit 16 is a so-called multi-head type recording unit in which a plurality of recording heads 17 (see FIG. 4) are arranged in a predetermined recordable arrangement (e.g., zigzag arrangement) over the whole area of the maximum width of the recording medium.

A transfer motor 56 shown in FIG. 3 corresponds to an electric motor 24 in FIG. 1, and the controller 14 (see FIG. 1) drives the transfer motor 56, so that the transfer belt 54 is driven at a constant speed in the transfer direction Y (the left side in FIG. 3) and thus the recording medium P on the transfer belt 54 is transferred at the constant speed in the transfer direction Y. Ink droplets are ejected from each recording head 17 (see FIG. 1) of the recording unit 16 to the recording medium P being transferred at the constant speed, so that the recording medium P is printed. Further, as shown in FIG. 3, the encoder 25 including a linear encoder is provided at the peripheral portion of one side of the surface of the transfer belt 54 over the whole periphery of the transfer belt 54. The encoder 25 includes a linear scale 25A and a sensor 25B having a light emitting and receiving function. The sensor 25B of the encoder 25 is connected to the N data control substrates 20 (see FIG. 1) through signal lines. In this regard, even in the case of the line printer 11B, the number of signal lines from the encoder 25 is N, which are connected to the N data control substrates 20.

Figures 4, 5:
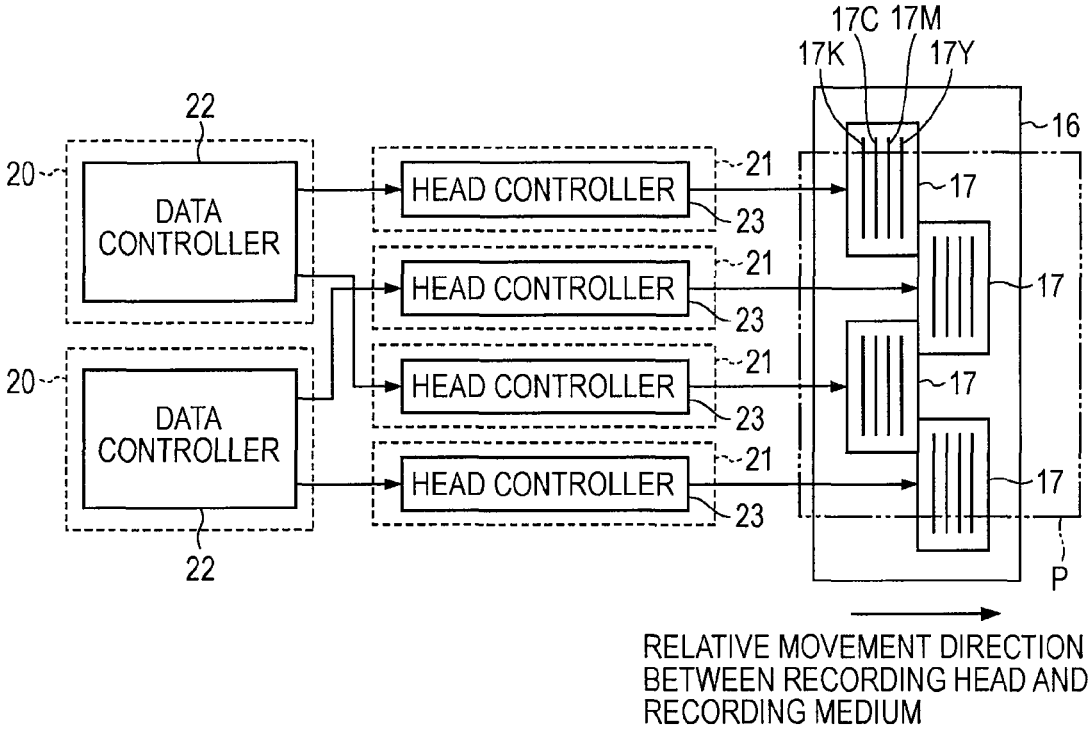
FIG. 4 is a block diagram illustrating the electrical configuration of a recording head unit.
FIG. 5 is a diagram illustrating table data.

FIG. 4 is a schematic diagram illustrating the bottom surface of the control circuit and the recording unit. In addition, FIG. 4 shows a simple example in which the number of connections of the head module substrates per one data control substrate is 2. As shown in FIG. 4, a plurality of recording heads 17 (e.g., four recording heads) constituting the recording unit 16 are arranged in a zigzag manner. Each recording head 17 is provided at a nozzle opening surface (a bottom surface) thereof with nozzle arrays 17K, 17C, 17M and 17Y of ink colors K, C, M and Y in which J number (e.g., 180) of nozzles (nozzle openings) are arranged at a predetermined nozzle pitch interval, respectively. The plurality of recording heads 17 are arranged in the zigzag manner, so that nozzle arrays with the same color between the recording head 17 obliquely adjacent to each other are continuously distributed in a nozzle array direction (a top and bottom direction in FIG. 4).

A right and left direction in FIG. 4 is a relative movement direction RM between the recording unit 16 and the recording medium. In the case of the serial printer 11A, the relative movement direction RM is the main scanning direction X of the carriage 31. Further, in the case of the line printer 11B, the relative movement direction RM is the transfer direction Y (i.e., the movement direction of the transfer belt 54) of the recording medium P. In this regard, in the case of the line printer 11B, each nozzle array with the same color of each recording head 17 is continuously arranged over the whole area of the maximum width direction of the recording medium.

As shown in FIG. 4, the two data controllers 22 control the M (2 in the example of FIG. 4) recording heads 17, which belong to different arrays of head arrays of two columns arranged in the zigzag arrangement, respectively. Thus, the M (2) recording heads 17 belonging to the same column are controlled by the head controllers 23, which corresponds to the recording heads 17, at the same ejection timing. In this way, even if a difference occurs in the position of the relative movement direction RM with respect to the recording medium P between the head arrays of the two columns, which each include the M recording heads 17, dots are printed at the same position of the relative movement direction RM on the recording medium P between the head arrays.

Figure 6:
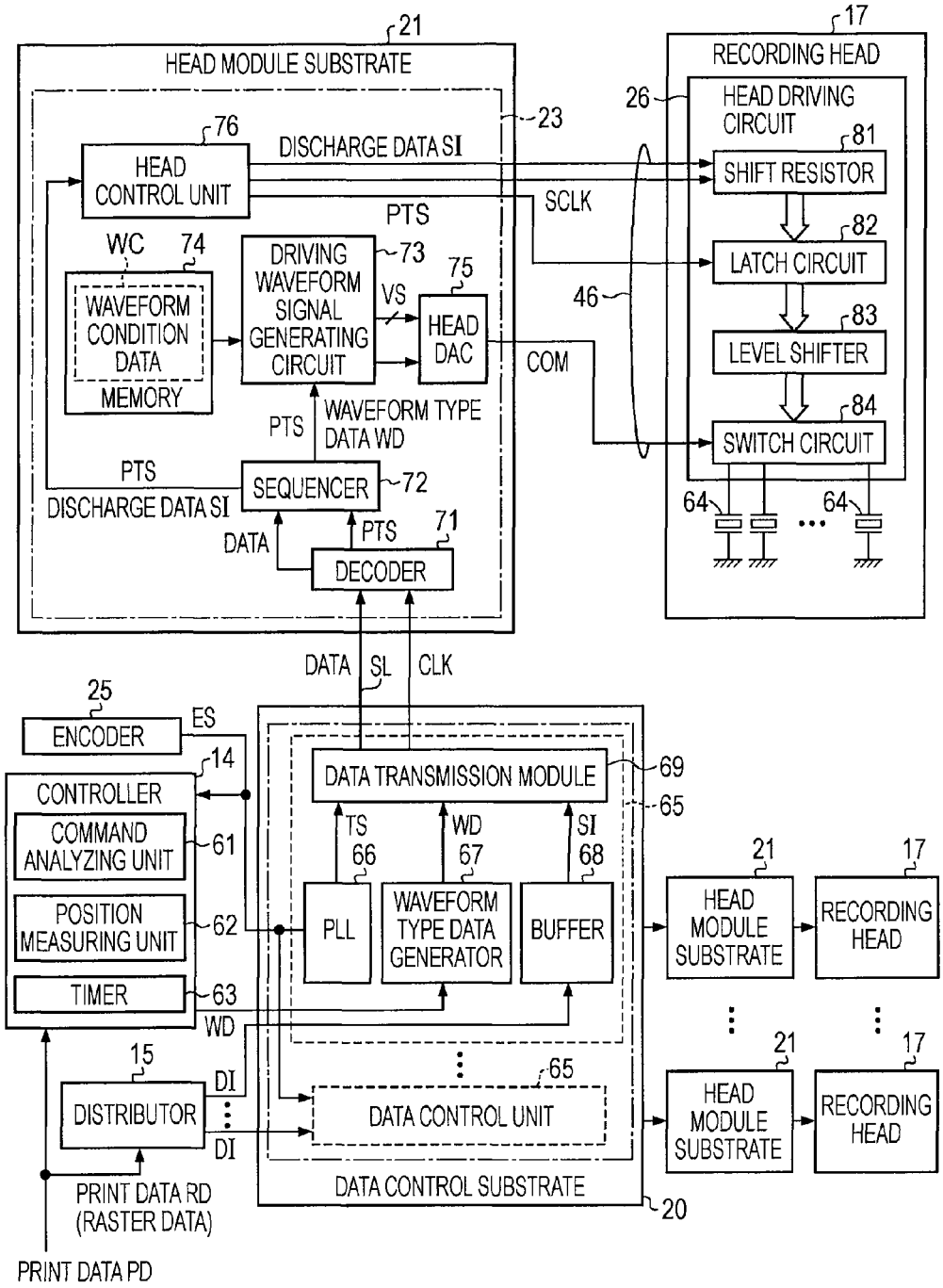
FIG. 6 is a detailed block diagram illustrating the electrical configuration of main elements of a recording head unit.

FIG. 6 is a block diagram illustrating the detailed electrical configuration of the recording head unit. As shown in FIG. 6, the controller 14 includes a command analyzing unit 61, a position measuring unit 62 and a timer 63. Further, the encoder pulse signal ES from the encoder 25 is also input to the controller 14.

The command analyzing unit 61 obtains the print condition information from the header of the printing data PD transmitted at the start of print job, and obtains "the print speed mode designation information" from the print condition information. Further, the command analyzing unit 61 analyzes the command of the printing data PD transmitted in units of one line, and controls the print driving system (except for the recording head 17) including the electric motor 24 and the like (see FIG. 1) according to the analyzed command. For example, the command includes a paper feeding command, a print command, a paper supply command, a paper discharge command and the like. In addition, the printing data PD corresponding to one line is printable data corresponding to one path (main scanning of one time) in the case of the serial printer, and is printable data corresponding to a plurality of nozzle arrays in the transfer direction in the case of the line printer.

The position measuring unit 62 measures the position of the recording head 17 relative to the recording medium P. The position measuring unit 62 receives two encoder pulse signals ES having A and B phases and a phase difference of 90°. In detail, the position measuring unit 62 has a counter and a direction signal generating circuit (not shown) therein. The direction signal generating circuit performs a phase comparison process with respect to the encoder pulse signals ES having the A and B phases, and outputs a direction signal, which represents whether the relative movement direction RM of the recording head 17 with respect to the recording medium P is a positive direction or a negative direction, to the counter. The counter is reset when the position of the recording head 17 relative to the recording medium P is an origin. Then, based on the direction signal, the counter increments by "1" whenever a pulse edge is input when the relative movement direction RM of the recording head 17 with respect to the recording medium P is the positive direction, but the counter decrements by "1" whenever a pulse edge is input when the relative movement direction RM of the recording head 17 with respect to the recording medium P is the negative direction. In this way, the counter of the position measuring unit 62 performs a counting operation by employing the position of the recording head 17 relative to the recording medium P located at the origin as a reference.

When the printer 11 is the serial printer 11A, the position measuring unit 62 measures the position (i.e., the carriage position) of the recording unit 16 in the main scanning direction X in which the home position of the carriage 31 is employed as the origin. Further, when the printer 11 is the line printer 11B, the position measuring unit 62 measures the transfer position of the recording medium P by employing the position when the front end of the recording medium P transferred on the transfer belt 54 is detected by a medium detection sensor (not shown) as the origin.

The controller 14 makes a determination as to whether the current position (e.g., the carriage position or the recording medium transfer position) of the recording head 17 relative to the recording medium P, which is measured by the position measuring unit 62, is within an area (a recording area) determined by the print data in which ink droplets can be ejected, or another area (a non-recording area) other than the recording area. As a result of the determination, when the current position of the recording head 17 relative to the recording medium P is within the non-recording area, the controller 14 allows the recording head 17 to drive an ejection driving element 64, which is provided in each nozzle, by weak force to the extent that the ink droplets are not ejected, so that ink in the nozzle is subject to micro-vibration, resulting in the prevention of ink clogging of the nozzle, which is called "a micro-vibration process".

The ejection driving element 64, for example, includes a piezoelectric vibration element or a electrostatic driving element. If a voltage pulse with a predetermined driving waveform is applied, the ejection driving element 64 vibrates an inner wall portion (a vibration plate) of an ink chamber, which communicates with the nozzle, by electrostrictive effect or electrostatic driving effect, so that the ink chamber is expanded and compressed, resulting in the ejection of ink droplets from the nozzle. Herein, the ejection driving element 64 may employ a heater that heats ink in a nozzle passage, or may allow ink droplets to be ejected from the nozzle by using expansion of bubbles generated due to boiling in the ink heated by the heater.

In addition, the timer 63 counts a time interval (e.g., a setting value of 10 to 30 seconds) at which a "refreshing process" is performed, which regularly removes stick ink in a non-ejection nozzle (a rest nozzle), and idly discharges ink droplets having no relation with printing to refresh ink in a nozzle, during the printing by the recording unit 16.

Herein, the waveform type parameter WP for determining the driving waveform of a voltage pulse to be applied to the ejection driving element 64 includes a "printing speed mode", "flushing" and "micro-vibration". Thus, if the driving waveform of the voltage pulse to be applied to the ejection driving element 64 is determined, the controller 14 transmits the driving waveform to the data controller 22 as the waveform type parameter WP.

When the time counted by the timer 63 is a flushing time having reached a time interval at which the flushing is to be performed, if the recording unit 16 does not face the recording medium P, the controller 14 performs flushing of idly discharging ink droplets from all nozzles of the recording head 17 toward a waste ink recovery unit located below the recording head 17 while facing the recording head 17.

At this time, in the case of the serial printer 11A, the controller 14 drives the carriage motor 37 (corresponds to the electric motor 24 of FIG. 1) to move the carriage 31 to the home position, thereby allowing the recording head 17 to perform the flushing toward a gap 45 and the like. Further, in the case of the line printer 11B, the controller 14 waits until the recording medium P is discharged to the position at which the recording medium P does not face the recording unit 16, and an opening formed in the transfer belt 54 faces each recording head 17, and then allows the recording head 17 to perform the flushing toward a waste ink recovery unit facing each recording head 17 while interposing the opening therebetween. When the flushing is performed, the controller 14 transmits discharge data for flushing and the waveform type parameter WP indicating the "flushing" to the data controller 22.

As shown in FIG. 6, the data controller 22 includes M data control units 65 corresponding to the M recording heads 17 respectively. Each of the data control units 65 includes a Phase Locked Loop (PLL) (phase synchronization circuit) 66, a waveform type data generator 67, a buffer 68 (a buffer memory) and a data transmission module 69. The encoder signal pulse ES input to the data controller 22 from the encoder 25 is input to the PLL 66 in each data control unit 65. Further, the discharge data DI input to the data controller 22 after being distributed from the distributor 15 to each recording head 17 is stored in each buffer 68 in units of one line.

The PLL 66 shown in FIG. 6 is an oscillation circuit that oscillates the oscillator in the loop by performing feedback control with respect to the oscillator such that a phase difference between the encoder pulse signal ES input from the encoder 25 as a reference signal and output from the oscillator in the loop becomes constant. Then, the PLL 66 generates a transmission timing signal TS with a pulse period which is equal to or ½ or ¼ corresponding to the pulse period of the encoder pulse signal ES, and outputs the transmission timing signal TS to the data transmission module 69. Thus, the pulse period of the transmission timing signal TS is shortened when the movement speed of the recording head 17 relative to the recording medium P is high, but is lengthened when the movement speed of the recording head 17 relative to the recording medium P is low. The transmission timing signal TS has a pulse period which is equal to the printing period for determining the print timing, and determines the pulse period of a print timing signal PTS which will be described later.

The waveform type data generator 67 shown in FIG. 6 obtains waveform type data WD of 16 bits, which corresponds to the waveform type indicated by the waveform type parameter WP, with reference to the table data TD of FIG. 5, which is stored in a storage section (e.g., a memory or a register), based on the waveform type parameter WP input from the controller 14. That is, the waveform type data generator 67 converts (encodes) the waveform type indicated by the waveform type parameter WP into the waveform type data of 16 bits with reference to the table data TD.

Hereinafter, the table data TD of FIG. 5 will be described. As shown in FIG. 5, the table data TD is a table representing the correspondence relationship between the waveform type parameter WP and the waveform type data WD. The waveform type parameter WP includes the "printing speed mode", the "flushing" and the "micro-vibration". Among them, the "printing speed mode" is further divided into Q types of "printing speed modes" ($Q \geqq 2$) including a "printing speed mode 1" to a "printing speed mode Q". Further, the waveform type data WD corresponding to each waveform type parameter WP is indicated by data of 16 bits. Herein, the data length (bit number) of the waveform type data WD can appropriately vary depending on the number of necessary waveform types and the like, and for example may employ 8 bits, 32 bits and the like.

Figure 7:
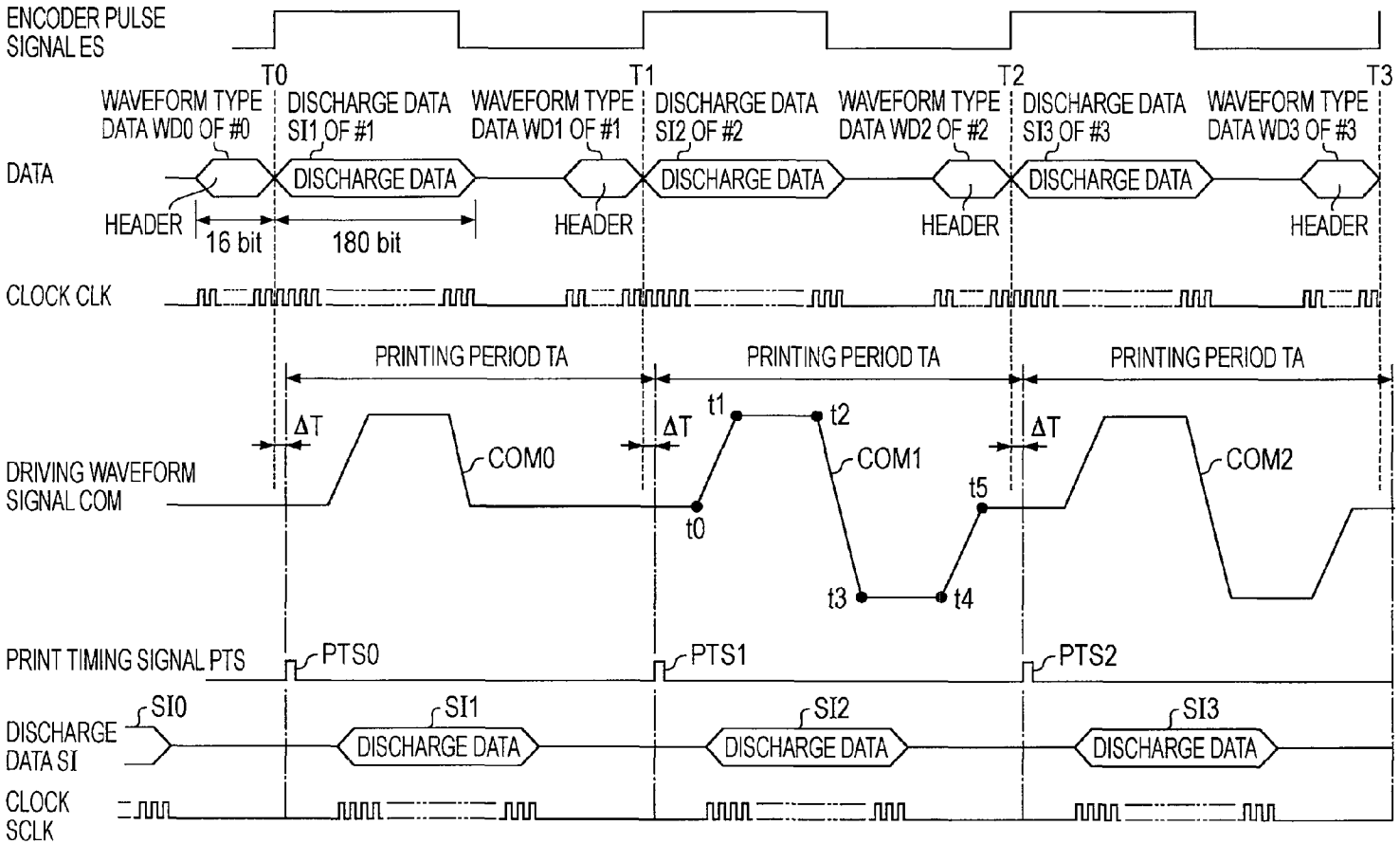
FIG. 7 is a timing chart according to data transmission.

The data transmission module 69 shown in FIG. 6 reads discharge data SI corresponding to one nozzle array (e.g., 180 nozzles) from the discharge data DI stored in the buffer 68, and generates data DATA by adding the waveform type data WD of 16 bits, which is input from the waveform type data generator 67, to the front of the discharge data SI as a header. Then, the data transmission module 69 transmits the data DATA in synchronization with output of a clock CLK at the transmission timing synchronized with the pulse period of the transmission timing signal TS from the PLL 66. Thus, the waveform type data WD (waveform designation signal) of 16 bits and the discharge data SI of 180 bits are sequentially transmitted to the head controller 23 at each transmission timing, which is proportional to the pulse period of the encoder pulse signal ES, through the same (common) data transmission line SL (a signal line) through which the substrates 20 and 21 are connected to each other. As a result, the head controller 23 receives the data DATA at the timing of each one printing period TA (see FIG. 7). Herein, the printing period TA is a dot forming period (an ink ejection period) in the relative movement direction RM between the recording head 17 and the recording medium P. In addition, FIG. 7 shows one example in which the printing period TA is proportional to the pulse period of the encoder pulse signal ES.

Meanwhile, as shown in FIG. 6, the head controller 23 includes a decoder 71, a sequencer 72, a driving waveform signal generating circuit 73, a memory 74, a head (Digital Analog Converter) DAC 75, and a head control unit 76.

The decoder 71 receives the data DATA from the data transmission module 69 in synchronization with the clock CLK, and decodes the waveform type data WD of 16 bits in the header of the data DATA. Then, the decoder 71 transmits decoded data DATA including the waveform type data WD and the discharge data SI to the sequencer 72.

Further, the decoder 71 generates a pulse at each reception timing of the data DATA, thereby generating the print timing signal PTS, which has a pulse period equal to the reception timing of the data DATA, and outputting the print timing signal PTS to the sequencer 72. Thus, the print timing signal PTS output from the decoder 71 has a pulse period equal to the printing period TA. In detail, the decoder 71 generates the pulse at each reception completion timing of the waveform type data WD of the data DATA, which is received in advance as the header, thereby generating the print timing signal PTS. In other words, the decoder 71 generates the pulse at each reception start timing of the discharge data SI (ejection information) of the data DATA, which is received subsequent to the header, thereby generating the print timing signal PTS.

The sequencer 72 transmits the waveform type data WD of the data DATA, which is received from the decoder 71, to the driving waveform signal generating circuit 73, and transmits the discharge data SI to the head control unit 76.

Further, if the print timing signal PTS is input from the decoder 71 during the reception of the data DATA, the sequencer 72 generates a pulse at the timing synchronized with the input timing of the print timing signal PTS, thereby generating a print timing signal PTS, which serves a trigger giving instructions for the generation of the driving waveform signal COM, and outputting the print timing signal PTS to the driving waveform signal generating circuit 73. At this time, the sequencer 72 also outputs the generated print timing signal PTS as a trigger giving instructions for the transmission of the discharge data SI to the head control unit 76.

The driving waveform signal generating circuit 73 receives the print timing signal PTS at the timing at which the reception of the waveform type data WD from the sequencer 72 is exactly completed. After receiving the print timing signal PTS, the driving waveform signal generating circuit 73 reads waveform condition data WC, which corresponds to the waveform type data WD received in advance, from the memory 74. Then, the driving waveform signal generating circuit 73 outputs a voltage indication signal VS, which indicates an output voltage for generating the driving waveform signal COM with a driving waveform corresponding to the designated waveform type, to the head DAC 75 according to the waveform condition data WC.

The head DAC 75 sequentially switches the output voltage into a voltage value indicated by the voltage indication signal VS from the driving waveform signal generating circuit 73, thereby generating and outputting the driving waveform signal COM with the driving waveform corresponding to the designated waveform type.

Meanwhile, the head control unit 76 includes a storage section (not shown, for example, a register or a memory) that temporarily stores the received discharge data SI. If the print timing signal PTS is input from the sequencer 72, the head control unit 76 reads the discharge data SI to be output from the storage section this time, and outputs the discharge data SI in synchronization with a clock SCLK. At this time, the head control unit 76 generates a pulse in synchronization with the input timing of the print timing signal PTS from the sequencer 72, thereby generating a print timing signal PTS and outputting the print timing signal PTS to the head driving circuit 26. Thus, the print timing signal PTS is output with the same pulse period as the printing period TA from the head control unit 76.

In addition, the sequencer 72 gives instructions for the generation of the driving waveform signal to the driving waveform signal generating circuit 73 or gives instructions for the output of the print timing signal PTS and the discharge data SI to the head control unit 76 according to the position of the recording head 17 relative to the recording medium P, which is measured by the position measuring unit 62, based on a preset program. Thus, when the position of the recording head 17 relative to the recording medium P reaches the next printing start position, the sequencer 72 outputs the print timing signal PTS at the time interval which is equal to the printing period at a slightly earlier timing such that ink droplets are ejected from the nozzles of the recording head 17.

In this way, the driving waveform signal COM, the print timing signal PTS and the discharge data SI are output to the head driving circuit 26 in the recording head 17 through the FCC 46.

As shown in FIG. 6, the head driving circuit 26 includes a shift register 81, a latch circuit 82, and a level shifter 83 and a switch circuit 84.

The shift register 81 receives the discharge data SI corresponding to one nozzle array. For example, if one nozzle array is 180 nozzles, the discharge data SI of 180 bits is input to the shift register 81. Each bit of the discharge data SI represents ejection and non-ejection of each nozzle. If each bit has a value of "0", it represents non-ejection. If each bit has a value of "1", it represents ejection.

The latch circuit 82 holds the discharge data SI from the shift register 81 until the print timing signal PTS is input, and then outputs the discharge data SI to the level shifter 83 in synchronization with the input timing of the print timing signal PTS.

The level shifter 83 functions as a voltage amplifier. When the bit has a value of "1", the level shifter 83 outputs an electrical signal capable of driving the switch circuit 84, for example, which is boosted to a voltage of about several tens of volts. The driving waveform signal COM is supplied to an input side of the switch circuit 84 from the driving waveform signal generating circuit 73, and the ejection driving element 64 is connected to an output side of the switch circuit 84.

The switch circuit 84 receives 180 electrical signals boosted/non-boosted according to the bit value from the level shifter 83 in a parallel manner. The supply of the electrical signals to the switch circuit 84 is determined according to whether the bit has a value of "0" or "1", so that on/off of a switch element in the switch circuit 84 corresponding to each ejection driving element 64 is switched, resulting in the selective supply of a voltage to the ejection driving element 64. For example, when the bit has a value of "1" in the interval of the printing period TA, since a corresponding switch element in the switch circuit 84 is turned on and a voltage pulse at this time is supplied to the ejection driving element 64, ink droplets are ejected from a corresponding nozzle. Meanwhile, when the bit has a value of "0" in the interval of the printing period TA, since a corresponding switch element in the switch circuit 84 is turned off and a voltage pulse at this time is not supplied to the ejection driving element 64, ink droplets are not ejected from a corresponding nozzle.

In the case of the serial printer 11A, while the carriage 31 moves in the main scanning direction X by one path, ink droplets are ejected from a nozzle at each ejection position in the main scanning direction of the recording head 17. In this way, after printing corresponding to one path is performed, paper supply is performed for each one path and a plurality of paths necessary for printing of one page, so that printing corresponding to one page is performed.

Meanwhile, in the case of the line printer 11B, the recording medium P on the transfer belt 54, which is driven in the transfer direction Y with respect to the fixed recording head 17, is transferred in the transfer direction Y, and ink droplets are ejected from a nozzle at each ejection position in the transfer direction Y. In this way, whenever data corresponding to one line is latched, printing corresponding to one line over the printing width of the recording medium P is continuously performed in units of one line. Consequently, print is performed in a line recording scheme.

FIG. 7 is a timing chart illustrating a data transmission process of the recording head unit. FIG. 7 shows the timing according to data transmission from the data controller 22 (in detail, the data transmission module 69 therein) to the head controller 23, and the transmission of the driving waveform signal COM and the discharge data SI from the data controller 22 to the recording head 17. Hereinafter, the transmission process and the like will be sequentially described from an upstream side on the data transmission passage. First, the transmission process of the data transmission module 69 in the data controller 22 will be described, and then the transmission process of the driving waveform signal generating circuit 73 and the head control unit 76 in the head controller 23 will be described. If necessary, the transmission process will be described with reference to FIG. 6 in addition to FIG. 7.

The data transmission module 69 in the data controller 22 shown in FIG. 6 reads discharge data SI corresponding to a subsequent one nozzle array of the discharge data DI stored in the buffer 68, and generates the data DATA by adding the waveform type data WD, which is achieved from the waveform type data generator 67, to the front of the discharge data SI as a header. Then, if the pulse of the transmission timing signal TS is input from the PLL 66, the data transmission module 69 starts to transmit the data DATA. As a result, the data DATA is transmitted from the data transmission module 69 to the head controller 23 in synchronization with the clock CLK as shown in FIG. 7. Thus, the header (the waveform type data WD) and the discharge data SI, which constitute the data DATA, are serially transmitted from the data transmission module 69 to the head controller 23 through the same data transmission line SL shown in FIG. 6.

The present example employs the configuration in which the control circuit of the recording head is divided into the N data control substrates 20 and the (N×M) head module substrates 21. Thus, it is necessary to transmit encoder pulse period information and waveform type information to the head module substrates 21. At this time, when employing the configuration in which an encoder signal line and a waveform type data transmission line are connected to the head module substrates, it is necessary to provide (N×M) encoder signal lines and (N×M) waveform type data transmission lines, respectively, resulting in a significant increase in the number of wirings. In this regard, according to the present embodiment, the encoder pulse signal ES and the waveform type information are transmitted to the N data control substrates 20, so that the number of wirings is restricted to a small number. In such a case, in relation to transmission of the encoder pulse period information from the data control substrates 20 and the head module substrates 21, the transmission timing of the data DATA (the waveform type data WD and the discharge data SI) is allowed to be proportional to the encoder pulse period, so that the encoder pulse period information is indirectly transmitted based on the period of the reception timing of the data DATA (the waveform type data WD and the discharge data SI) in the head module substrates 21.

Further, in relation to the waveform type information, the data DATA, which is achieved by adding the waveform type data WD to the discharge data SI as a header, is serially transmitted from the data control substrates 20 to the head module substrates 21. As described above, the waveform type data WD is transmitted using the data transmission line SL of the discharge data SI, so that addition of a data transmission line dedicated for the waveform type data can be avoided. Consequently, in the present example, one encoder signal line from the encoder 25 and one waveform type data transmission line from the controller 14 are connected to each data control substrate 20, in which the total number of the signal lines is N.

Further, if the number of transmissions of the data DATA in FIG. 7 is set to #0, #1, #2, . . . , the data transmission module 69 generates data DATA by combining waveform type data WDn of #n with discharge data SIn+1 (n=0, 1, 2, . . . ) of #n+1. That is, the data transmission module 69 generates the data DATA by combining waveform type data WD of this time with discharge data SI of the next time. Thus, as shown in FIG. 7, after data DATA, which is achieved by combining waveform type data WD0 of #0 with discharge data SI1 of #1, is transmitted, data DATA, which is achieved by combining waveform type data WD1 of #1 with discharge data SI2 of #2, is transmitted with the passage of time which is equal to the printing period TA. Then, according to the same rule, data DATA is sequentially transmitted every printing period TA.

In FIG. 7, the recording head 17 is within a non-recording area in the interval before #0, and is within a recording area in the interval after #1. When the recording head 17 is within the non-recording area, a waveform of micro-vibration is selected in the case of ejection control. When the recording head 17 is within the recording area, a waveform of a printing speed mode m (m is a value of a printing speed mode determined from printing conditions set at a corresponding time point from 1 to Q) is selected in the case of the ejection control. That is, the waveform type data WD up to #0 is a waveform of "micro-vibration" and the waveform type data WD from #1 is a waveform of the printing speed mode m. As shown in FIG. 7, the discharge data SI0 of #0 transmitted before the time T0 is for micro-vibration, for example, is discharge data having a bit value of "1". Thus, data DATA is transmitted, which is achieved by combining the waveform type data WD0 of "micro-vibration" of #0 with the initial discharge data SI1 of #1 in the recording area.

At this time, as shown in FIG. 7, the driving waveform signal generating circuit 73 generates and transmits a driving waveform signal COM0 of micro-vibration, which is indicated by the waveform type data WD0, at the printing period TA subsequent to the reception timing of the waveform type data WD0 of the "micro-vibration" of #0. Then, the head driving circuit 26 applies a voltage pulse of a driving waveform based on the driving waveform signal COM0 to all ejection driving elements 64, so that micro-vibration when the recording head 17 is within the non-recording area is made. As described above, according to the present embodiment, if the waveform type indicated by the waveform type data WD is changed from a first waveform to a second waveform, the driving waveform (the driving waveform signal COM) being the second waveform is transmitted with the next period (the printing period TA) after the waveform designation signal (the waveform type data WD) designating the second waveform is received.

In this regard, in the non-recording area, data DATA, which is achieved by combining the waveform type data WDn designating the waveform of micro-vibration with the discharge data SIn+1, is sequentially transmitted. When the recording head 17 enters the recording area from the non-recording area, since the waveform designation content based on the waveform type data WD is changed from the "micro-vibration" to the "printing speed mode m", the driving waveform signal generating circuit 73 generates the driving waveform signal COM with the waveform of the "printing speed mode" after the change in a printing period TA subsequent to the printing period TA in which the waveform type data WD having changed the designation waveform is received.

When the recording head 17 performs printing in the recording area, data DATA, which is achieved by combining the waveform type data WDn designating the waveform of the "printing speed mode m" with the discharge data SIn+1, is sequentially transmitted from the data transmission module 69 to the head controller 23. The driving waveform signal generating circuit 73 in the head controller 23 generates a driving waveform signal COMn with the waveform of the "printing speed mode m", which is designated by the waveform type data WDn, in a printing period TA subsequent to a printing period TA in which the waveform type data WDn designating the waveform of the "printing speed mode m" is received, and transmits the driving waveform signal COMn to the head driving circuit 26. As a result, the driving timing is controlled based on the driving waveform signal COMn, so that the recording head 17 ejects ink droplets, for example, every printing period TA.

In addition, when the recording head 17 enters the non-recording area from the recording area, the waveform type indicated by the waveform type data WD of the data DATA transmitted from the data transmission module 69 is changed from the "printing speed mode m" to the "micro-vibration". At this time, the driving waveform signal generating circuit 73 generates the driving waveform signal COM with the waveform of the "micro-vibration", which is indicated by the waveform type data WD, in a printing period TA subsequent to the printing period TA in which the waveform type data WD with the designated the waveform of the "micro-vibration" is received, and transmits the driving waveform signal COM to the head driving circuit 26. As a result, when the recording head 17 is within the non-recording area and printing is not performed, the recording head 17 is subject to micro-vibration.

Furthermore, during printing, if the timer 63 completes the counting of the time interval for flushing and a flushing time is reached, the data transmission module 69 transmits data DATA, which is achieved by combining the waveform type data WDn designating "flushing" with the discharge data SIn+1 for flushing, which has a bit value of "1", to the head controller 23. If the waveform indicated by the waveform type data WD is changed from the waveform (the first waveform) of the "printing speed mode m" or the "micro-vibration" to the waveform (the second waveform) of the "flushing", the driving waveform signal generating circuit 73 generates the driving waveform signal COM with the waveform of the "flushing", which is indicated by the waveform type data WD, in a printing period TA subsequent to the printing period TA in which the waveform type data WD designating the "flushing" is received, and transmits the driving waveform signal COM to the head driving circuit 26. As a result, since the recording head 17 is located at the flushing position just above the waste ink recovery unit, ink droplets are idly discharged from the nozzle of the recording head 17 toward the waste ink recovery unit, which is called flushing.

Meanwhile, the decoder 71 shown in FIG. 6 decodes the waveform type data WD of the data DATA, which is received from the data transmission module 69, and transmits the waveform type data WD to the sequencer 72. At this time, the decoder 71 generates a pulse every reception completion timing of the heater (the waveform type data WD) of 16 bits, thereby generating the print timing signal PTS having a pulse period which is equal to the printing period TA in synchronization with the reception completion timing, and outputting the print timing signal PTS to the sequencer 72.

At the pulse input time point of the print timing signal PTS in the sequencer 72, the waveform type data WDn of #n is approximately transmitted to the driving waveform signal generating circuit 73, and the discharge data SIn of #n before the first time has been previously transmitted to the head control unit 76. Thus, the sequencer 72 generates a print timing signal PTS with the period synchronized with the pulse period of the received print timing signal PTS, and outputs the print timing signal PTS to the driving waveform signal generating circuit 73 and the head control unit 76. The print timing signal PTS serves as a trigger giving instructions for the start of generation of the driving waveform signal COM with respect to the driving waveform signal generating circuit 73, and serves as a trigger giving instructions for the start of transmission of the discharge data SI with respect to the head control unit 76.

If the print timing signal PTS is input, the driving waveform signal generating circuit 73 shown in FIG. 6 reads the waveform condition data WC corresponding to the waveform type data WD from the memory 74, and outputs a voltage indication signal to the head DAC 75 according to the waveform condition data WC. The head DAC 75 outputs a voltage indicated by the voltage indication signal, thereby generating the driving waveform signal COM and transmitting the driving waveform signal COM to the head driving circuit 26. For example, if the waveform type data WD corresponds to the "micro-vibration", the driving waveform signal COM with the same waveform as the driving waveform signal COM0 shown in FIG. 7 is transmitted to the head DAC 75. Further, if the waveform type data WD corresponds to the "printing speed mode m", the driving waveform signal COM with the same waveform as the driving waveform signal COM1 shown in FIG. 7 is transmitted to the head DAC 75.

Herein, the waveform condition data WC stored in the memory 74 shown in FIG. 6 is used for forming the waveform of the driving waveform signal COM. The waveform condition data WC includes a time elapsed from the generation start time point of the driving waveform signal COM (the start time point of the printing period TA), an indicated voltage, a waveform slope, a voltage holding time and the like. For example, in the example of FIG. 7, the waveform condition data WC is set as follows. After the driving waveform signal COM1 starts to be generated, a voltage is increased with a predetermined slope from the time t0 to the time t1 and is constantly held from the time t1 to the time t2. Then, the voltage is reduced with a predetermined slope from the time t2 to the time t3, is constantly held from the time t3 to the time t4, and is increased with a predetermined slope from the time t4 to the time t5.

In addition, as the waveform condition data WC of the "flushing", waveform conditions similar to waveform conditions of the "printing speed mode m" have been previously determined. For example, according to the waveform condition data WC of the "flushing", a waveform equal to the maximum waveform (a waveform during printing) of the "printing speed mode m" is formed, or a waveform (a waveform with a large voltage deviation) stronger than the maximum waveform is formed. Further, according to the waveform condition data WC of the "micro-vibration", a waveform (a waveform with a small voltage deviation), which is sufficiently weaker than any waveform (the waveform during printing) of the "printing speed mode" to the extent that ink droplets cannot be discharged, is formed, and the waveform of the driving waveform signal COM0 of the micro-vibration in FIG. 7 is formed.

Meanwhile, the head control unit 76 shown in FIG. 6 outputs the print timing signal PTSn with the period synchronized with the pulse period of the print timing signal PTS input from the sequencer 72, and starts to transmit the discharge data SIn+1 of #n+1 at this time. At this time, as shown in FIG. 7, at a rising edge timing of the pulse of a print timing signal PTSn, the printing period TA starts and a driving waveform signal COMn starts to be generated. Herein, as shown in FIG. 7, the print timing signal PTSn is delayed by a predetermined time ΔT with respect to the reception completion timing (which is approximately equal to the pulse rising edge of the encoder pulse signal ES) of the header (the waveform type data WD) of the data DATA. However, the predetermined time ΔT corresponds to the time required for the internal process of the head controller 23. As described above, the head controller 23 transmits the driving waveform signal COM at the timing after the predetermined time ΔT lapses from the reception completion of the waveform type data WD.

Until the time point at which the print timing signal PTSn is input to the latch circuit 82 as a latch signal, the discharge data SIn of #n is latched by the latch circuit 82. Then, if the print timing signal PTSn is input to the latch circuit 82, the latched discharge data SIn of #n is output to the level shifter 83. In addition, when the discharge data SIn has a bit value of "1", the level shifter 83 boosts a voltage, a voltage pulse with a driving waveform according to the driving waveform signal COMn is applied to the ejection driving element 64 corresponding to the switch element of the switch circuit 84, to which the boosted voltage is applied. As a result, the ejection driving element 64 corresponding to the bit value of "1" is driven. For example, in the case of the printing speed mode m, ink droplets are ejected from a corresponding nozzle.

According to the present embodiment as described above, the following effect can be achieved.

(1) the data DATA is transmitted from the data control substrate 20 to the head module substrate 21 with the period synchronized with the pulse period of the encoder pulse signal ES, and the head module substrate 21 acquires the period according to the printing period TA proportional to the pulse period of the encoder pulse signal ES from the period of the reception timing of the data DATA. Thus, the signal line of the encoder 25 is just connected to the data control substrate 20, and it is not necessary to connect the encoder signal line to each head module substrate 21. In addition, it is not necessary to provide a signal line (a timing signal line) dedicated for transmitting the encoder pulse period information between the data control substrate 20 and each head module substrate 21.

(2) the data DATA, which is achieved by adding the header to the discharge data SI, is transmitted from the data control substrate 20 to the head module substrate 21, and the head module substrate 21 transmits the period information of the encoder pulse signal ES to the head module substrate 21 with the period of the reception completion timing of the header. Thus, if a pulse is generated with the period synchronized with the period of the reception completion timing of the header, the head module substrate 21 can generate the print timing signal PTS with the pulse period synchronized with the printing period TA. Consequently, even if the encoder pulse signal ES is directly input to the head module substrate 21, the print timing signal PTS can be generated. For example, in the case of a configuration in which a predetermined timing in the middle of receiving the header is employed as a basis, the counting process of counting the time elapsed from the reception start time point of the header may be necessary. However, since the reception completion timing of the header is employed, even if such a counting process is not performed, the head module substrate 21 can obtain the timing every predetermined period (the printing period TA) proportional to the encoder pulse period.

(3) the waveform type data WD put into the header added to the discharged data SI (the ejection information) is transmitted, so that the waveform type data WD can be transmitted using the data transmission line SL (the serial transmission line) for the discharged data SI. Thus, the head controller 23 can transmit the driving waveform signal COM at the timing based on the reception timing of the waveform type data WD (the waveform designation signal). Therefore, it is not necessary to separately provide a data transmission line dedicated for transmitting the waveform type data WD between the data control substrate 20 and the head module substrate 21. Consequently, the number of wirings connected to the substrates 20 and 21 can be reduced. Thus, the recording head unit including the recording unit 16 and the substrates 20 and 21 can be formed with a relatively simple wiring structure and can be relatively simply assembled.

(4) the decoder 71 of the head module substrate 21 generates the print timing signal PTS with the period synchronized with the reception completion timing of the header (the waveform type data WD). Consequently, directly after the waveform type data WD is received, the driving waveform signal COM with the designated waveform can be immediately generated. For example, when employing a configuration in which the print timing signal PTS is generated at the timing earlier than the reception completion timing of the waveform type data WD, the obtainment of the waveform type data WD required at the start time point of the printing period TA may be delayed. In such a case, the use of the waveform type data WD may be waited for up to the printing period TA after the first time, and a storage area (a memory area or a register) may be increased by twice in order to hold two pieces of waveform type data WD. However, according to the embodiment, the pulse of the print timing signal PTS is generated according to the reception completion timing of the waveform type data WD, so that the holding time of the waveform type data WD can be sufficiently reduced as compared with the printing period TA, and it is possible to provide a necessary storage area with a relatively small size enough to hold one piece of waveform type data WD.

(5) it is not necessary to connect the encoder signal line to the head module substrates 21, so that the number of connections of the head module substrates 21 with respect to one data control substrate can be set to a plural number (M, M≧2) without an increase in the signal lines. Consequently, the number of connections of the head module substrates 21 per one data control substrate can be selected within the maximum range of M, so that the recording head unit can be constructed without the wastefulness of a circuit.

(6) the driving waveform signal generating circuit 73 (waveform generator) transmits the driving waveform signal COM having the designated waveform type with the period synchronized with the reception period of the waveform type data WD (the waveform designation signal). At this time, when the waveform designated by the waveform type data WD is changed from the first waveform to the second waveform, the driving waveform signal generating circuit 73 transmits the driving waveform signal COM with the second waveform from the printing period TA subsequent to the printing period TA in which the waveform type data WD designating the second waveform is received. Consequently, the driving waveform signal generating circuit 73 can transmit the driving waveform signal COM with the second waveform designated immediately from the subsequent printing period TA. Accordingly, the waiting time from the time point at which the waveform designated by the waveform type data WD is changed to the transmission of the driving waveform signal COM with the changed waveform can be reduced. For example, since the holding time for holding the waveform type data WD designating the waveform of the driving waveform signal COM generated in the subsequent printing period TA is short, the size of a storage area for storing the waveform type data WD can be reduced.

The invention is not limited to the previous embodiment. For example, the following modifications can be made.

Figure 8:
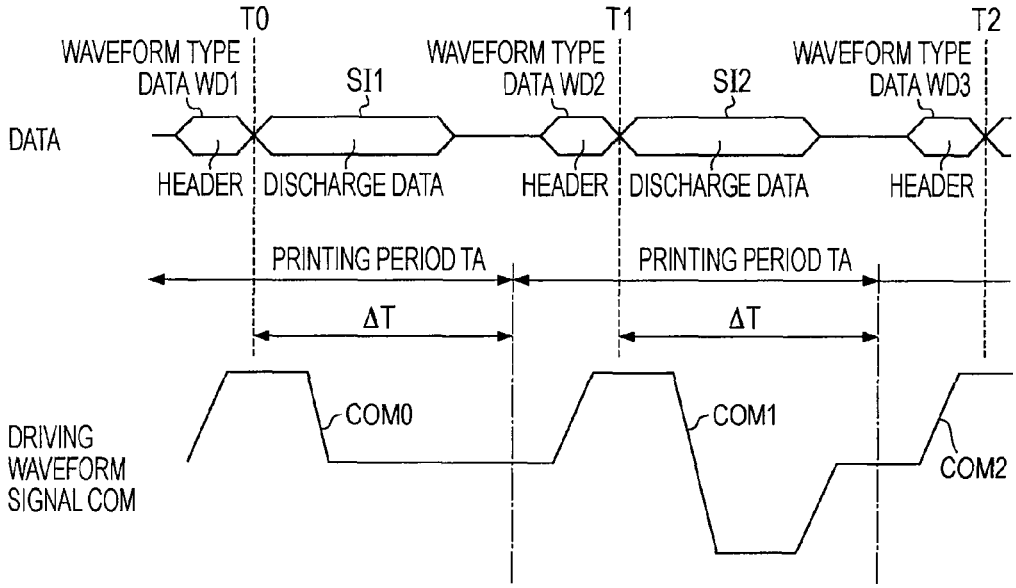
FIG. 8 is a timing chart illustrating a modified example in which a driving waveform signal is transmitted at a reception timing of waveform type data.

The predetermined time ΔT can be appropriately changed. In such a case, the predetermined time ΔT is not limited to the time (internal processing time) required for the internal process of the head controller 23. As shown in FIG. 8, the predetermined time ΔT can be set to be longer than the internal processing time. For example, after a counting unit such as a timer (a counting counter) is provided in the head controller 23, the reception completion time point of the waveform type data WD of the data DATA is employed as a reference time point, and it may be possible to start the generation (transmission) of the driving waveform signal COM at the time point at which the counting unit has finished counting a setting time (=the predetermined time ΔT−the internal processing time) at which the generation of the driving waveform signal COM can be started after the predetermined time ΔT lapses from the reference time point. With such a configuration, the predetermined time ΔT shown in FIG. 8 can be appropriately adjusted within the range which is equal to or more than the internal processing time and is equal to or less than the printing period TA. For example, the transmission timing of the driving waveform signal COM of #n and the print timing signal PTSn can be adjusted according to the transmission timing of the discharge data SIn of #n from the head controller 23, so that the latch time of the discharge data SIn in the head driving circuit 26 in the recording head 17 can be prevented from being delayed by one printing period TA. In addition, in the present specification, the predetermined time ΔT may also include 0 when the internal processing time is ignorable.

Figure 9:
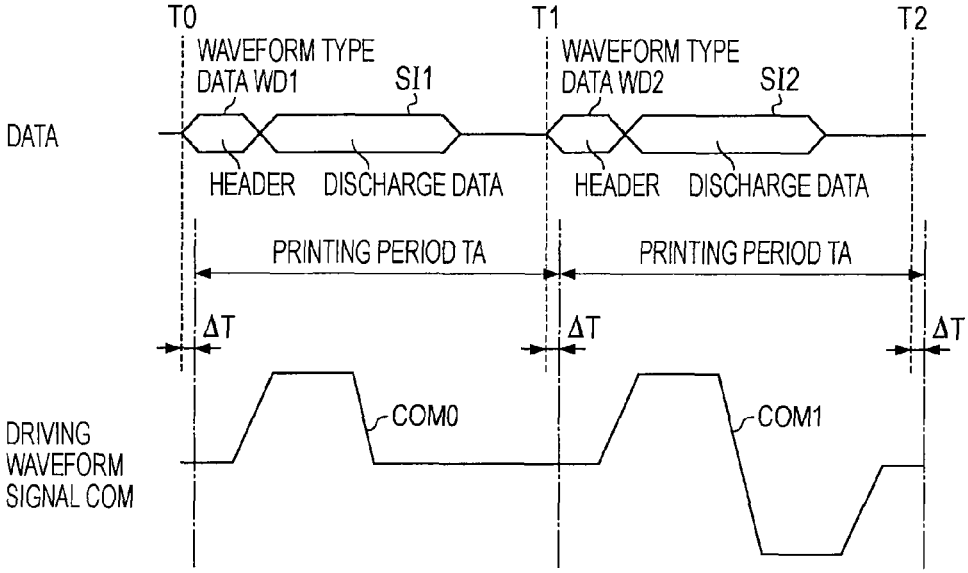
FIG. 9 is a timing chart illustrating another modified example (different from the modified example of FIG. 8) in which a driving waveform signal is transmitted at a reception timing of waveform type data.

As shown in FIG. 9, it may be possible to employ a configuration in which the reception start timing of the waveform type data WD (the header) is employed as a reference time point, and the time point after the predetermined time ΔT lapses from the reference time point is employed as the transmission start timing (the generation start timing) of the driving waveform signal COM. In such a case, data DATA is achieved by combining the waveform type data WDn of #n with the discharge data SIn of #n, and the generation (transmission) of the driving waveform signal COMn is started at a printing period TA subsequent to the printing period TA in which the waveform type data WDn (the waveform designation signal) is received.

The waveform type data WD and the discharge data SI may also be transmitted from the data control substrate 20 to the head module substrate 21 using a separate data transmission line (a signal line) without using the same data transmission line SL (the signal line).

Instead of two grayscales (the existence and absence of ejection) of only one type of dot size, grayscale printing capable of selecting dot sizes step by step may also be performed. For example, as disclosed in JP-A-2003-1824, ink droplets may also be ejected with four grayscales of large, medium and small dot sizes. In such a case, for example, it is required to use the driving waveform signal disclosed in JP-A-2003-1824 as the driving waveform signal COM, and transmit the driving waveform signal COM with the period synchronized with the reception timing of the waveform type data WD. In addition, other grayscales such as five grayscales and eight grayscales may also be employed. In such a case, as disclosed in JP-A-2003-1824, it is required to add SP data (selection waveform designation data), which designates one or plural waveforms to be selected from plural waveforms constituting the driving waveform signal COM, to the discharge data SI.

The target (the recording medium) is not limited to a paper. For example, a resin film, a metallic film, fabric, a CD, an optical disk such as a DVD, a magnetic disk, a circuit substrate and the like may also be employed as the target.

In the previous embodiment, the fluid ejecting apparatus is embodied as an ink jet printer. However, the invention can be applied to a fluid ejecting apparatus that ejects liquid droplets as fluid other than ink. Herein, the liquid droplets are in a liquid state, which are discharged from the fluid ejecting apparatus, and may include a grain shape with a long tail, teardrops with a long tail, and a thread shape with a long tail. Further, the fluid may include various materials which can be ejected from the fluid ejecting apparatus. For example, the fluid may denote materials in a liquid phase, and may include liquid-phase materials having high or low viscosity, sol, gel water, and materials in a flowing state such as inorganic solvents, organic solvents, solutions, liquid phase resin and liquid phase materials (metal melt). Further, the fluid may include materials, which are achieved through dissolution, dispersion or mixing between particles of functional materials including solid materials (e.g., pigments or metal particles) and solvent, as well as liquid as one state of a material. Further, the ink, liquid crystal or the like are a representative example of the liquid. The ink may include various liquid compositions such as normal water-based ink, solvent-based ink, gel ink and hot melt ink. In addition, the fluid includes powdered fluid. For example, the powdered fluid may include toner and the like. In detail, the fluid ejecting apparatus, for example, may include a fluid ejecting apparatus that ejects liquid including dispersed or dissolved electrode materials or color materials, which are used for manufacturing a liquid crystal display, an electroluminescence (EL) display, a surface emitting display, a color filter and the like, toward a medium (a target) such as a substrate, a fluid ejecting apparatus that ejects bio-organic materials used for manufacturing a bio chip toward the medium, a fluid ejecting apparatus used as a precise pipette to eject liquid serving as a specimen toward the medium, a dyeing apparatus, a micro-dispenser and the like. In addition, it may be possible to employ a fluid ejecting apparatus that ejects lubricating oil through a pin point while transferring a precision apparatus such as a watch or a camera, a fluid ejecting apparatus that ejects transparent resin solution, such as UV curing resin, onto a substrate (a target) to form a micro hemispheric lens (an optical lens) used for a light communication device and the like, and a fluid ejecting apparatus that ejects etchant such as acid or alkali to etch a target such as a substrate. In addition, the fluid in the present specification does not include fluid including only gas.

What is claimed is:

1. A fluid ejecting apparatus comprising:

a fluid ejecting head that ejects fluid;

a waveform generator that transmits a driving waveform for driving the fluid ejecting head to the fluid ejecting head; and a waveform designation signal transmitter that transmits a waveform designation signal for designating a driving waveform to be generated to the waveform generator, wherein the waveform generator transmits the driving waveform at a timing based on a reception timing of the waveform designation signal.

2. The fluid ejecting apparatus according to claim 1, wherein the waveform designation signal transmitter transmits the waveform designation signal and information regarding existence or absence of ejection in the fluid ejecting head through a single signal line.

3. The fluid ejecting apparatus according to claim 1, wherein the waveform generator is provided in a plural number, and the waveform designation signal transmitter separately transmits the waveform designation signal to each waveform generator.

4. The fluid ejecting apparatus according to claim 1, wherein the waveform generator transmits the driving waveform at a timing after a predetermined time elapses from reception start of the waveform designation signal or reception completion of the waveform designation signal.

5. The fluid ejecting apparatus according to claim 1, wherein the waveform generator transmits the driving waveform with a period synchronized with a reception period of the waveform designation signal, and, when a waveform designated by the waveform designation signal is changed from a first waveform to a second waveform, the waveform generator transmits the driving waveform with the second waveform from a period subsequent to a period in which a waveform designation signal for designating the second waveform is received.

6. The fluid ejecting apparatus according to claim 1, wherein the waveform designation signal designates the driving waveform to be generated by indicating a type of waveform, the driving waveform transmitted by the waveform generator being of the indicated type.

7. The fluid ejecting apparatus according to claim 6, further comprising a controller that transmits a waveform type parameter to the waveform designation signal transmitter indicating the type of waveform, wherein the waveform designation signal transmitter converts the waveform type parameter to data included in the transmitted waveform designation signal.

8. The fluid ejecting apparatus according to claim 7, wherein the waveform designation signal transmitter converts the waveform type parameter to the data with reference to a predetermined correspondence of different waveform type parameters to different data.

9. A fluid ejecting head control method in a fluid ejecting apparatus provided with a fluid ejecting head that ejects fluid, the method comprising:

transmitting by a waveform designation signal transmitter a waveform designation signal for designating a driving waveform to be generated to the waveform generator; and transmitting by a waveform generator a driving waveform for driving the fluid ejecting head to the fluid ejecting head at a timing based on a reception timing of the waveform designation signal.

10. The fluid ejecting head control method according to claim 9, wherein the waveform designation signal designates the driving waveform to be generated by indicating a type of waveform, the driving waveform transmitted by the waveform generator being of the indicated type.

11. The fluid ejecting head control method according to claim 10, further comprising transmitting a waveform type parameter to the waveform designation signal transmitter indicating the type of waveform, and converting the waveform type parameter to data included in the transmitted waveform designation signal.

12. The fluid ejecting apparatus according to claim 11, wherein converting the waveform type parameter to the data comprises referring to a predetermined correspondence of different waveform type parameters to different data.

13. A driving waveform generating apparatus for a fluid ejecting head, comprising:

a waveform generator that generates a driving waveform for driving a fluid ejecting head that ejects fluid and transmits the driving waveform to the fluid ejecting head, wherein the waveform generator receives a waveform designation signal for designating a driving waveform to be generated from a waveform designation signal transmitter that transmits the waveform designation signal for designating the driving waveform to be generated, and generates a driving waveform designated by the waveform designation signal and transmits the generated driving waveform to the fluid ejecting head at a timing based on a reception timing of the waveform designation signal.

14. The driving waveform generating apparatus according to claim 13, wherein the waveform designation signal designates the driving waveform to be generated by indicating a type of waveform, the driving waveform transmitted by the waveform generator being of the indicated type.

* * * * *